United States Patent [19]

Clark

[11] Patent Number: 5,009,547

[45] Date of Patent: Apr. 23, 1991

[54] WATER SPRAY FOR CEMENT FINISHER

[76] Inventor: Jeff A. Clark, 225 W. El Norte #206, Escondido, Calif. 92026

[21] Appl. No.: 463,521

[22] Filed: Jan. 11, 1990

[51] Int. Cl.[5] ..... E01C 19/22

[52] U.S. Cl. ..... 404/112; 239/129; 239/146; 239/76; 239/533.1

[58] Field of Search ..... 404/83, 112; 239/146, 239/76, 101, 99, 754, 274, 533.1, 129, 375, 376; 51/117, 266, 267

[56] References Cited

U.S. PATENT DOCUMENTS

| | | | |
|---|---|---|---|
| 2,109,933 | 3/1938 | Sloan | 404/112 |
| 2,181,375 | 11/1939 | Leistner et al. | 404/112 |
| 2,361,981 | 11/1944 | Tirrell | 239/129 |
| 2,865,671 | 12/1958 | Jensen | 239/129 |
| 2,869,442 | 1/1959 | Mincher | 404/112 |
| 3,140,574 | 7/1964 | Brown | 239/129 |
| 3,338,524 | 8/1967 | Rhein et al. | 239/129 |
| 3,361,044 | 1/1968 | Wolf et al. | 404/112 |
| 3,425,407 | 2/1969 | Furman et al. | 239/129 |
| 3,458,885 | 8/1969 | Danielsson | 404/112 |
| 4,331,297 | 5/1982 | Gipson | 404/112 |

FOREIGN PATENT DOCUMENTS

| | | | |
|---|---|---|---|
| 79616 | 7/1955 | Denmark | 239/129 |

*Primary Examiner*—Ramon S. Britts
*Assistant Examiner*—Roger J. Schoeppel

[57] ABSTRACT

This invention is an improvement to a machine for treating cement or other flooring surfaces having a frame, a handle on the frame, an internal combustion engine on the frame and a rotary finishing means on the frame. The improved apparatus has a fluid tank on the handle pressurized by the exhaust system of the engine. Included are pressure connection means to connect a pressure conduit to the tank and to the exhaust system of the engine. There is a pressurization regulation means to control the pressure received by the tank and a control means to control the flow of the pressurized fluid leaving the tank to be distributed upon the flooring surface by at least two nozzles with varying diameter passageways through the nozzles to allow the user to choose the rate of flow of fluids distributed on the surface. Included are an actuation means and a linkage means to assist the operator in the selection of the desired fluid flow.

5 Claims, 1 Drawing Sheet

WATER SPRAY FOR CEMENT FINISHER

BACKGROUND OF THE INVENTION

1. Field of the Invention

This invention relates to an improved apparatus for treating cement or other flooring surfaces having a frame, a handle on the frame, an internal combustion engine on the frame and a rotary finishing means on the frame powered by the engine. Wherein the improvement includes having a pressurization means to pressurize a fluid tank with pressure supplied by an exhaust system of an internal combustion engine and a control and nozzle means to direct the flow of the fluid.

2. Description of the Related Art

Finishing concrete, terrazzo or other flooring surfaces is arduous work which must be completed before the surfacing material dries. As the surfacing material begins to dry, the smoothing or trowelling effort becomes more difficult. In order to facilitate the operation and to permit the finisher to prepare a larger area of surface, motorized masonry trowels have been introduced.

These machines are usually powered by small internal combustion engines and have three or four rotating blade-like trowels which contact the moist pliable surfacing material. The rotating trowels aid in smoothing the surface of the surfacing material. A finisher is presented with rapidly charging surface conditions as the material begins to dry. In order to obtain a smooth surface, the finisher must work quickly before the surface dries. Weight and balance of the trowelling device is often crucial to smooth surface and to reduce the exertion of the operator.

In order to keep the surface moist and pliable longer, water is often added to water soluble materials to give the operator more time to smooth the surface while the surface is still moist and pliable. One difficulty encountered is that the rotating trowel device described above often takes both hands to operate it as it is directed about the surface. A second person is often required to distribute water about the surface to aid the trowel operator. This method often does not promote even distribution of the water on the surface to be smoothed and requires the trowel operator to divide his attention between the trowel and supervision of the water distribution person often to the detriment of the smoothness of the surface.

U.S. Pat. No. 2,109,933 to issued to F. P. Sloan on Mar. 1, 1938 describes a machine for smoothing floors with a tank placed over the engine with gravity feed of the water falling on the disk. U.S. Pat. No. 2,181,375 issued to C. A. Leistner, et al. on Nov. 28, 1939 for a finishing device has a tank on a frame around the engine and has an air compressor to pressurize the tank. U.S. Pat. No. 2,869,442 to J. M. Mincher on Jan. 20, 1959 describes a floating trowelling machine upon which the user sits. The machine has a gravity fed water system. U.S. Pat. No. 3,361,044 to C. R. Wolf, et al. on Jan. 2, 1968 for a cement finishing apparatus provides a doughnut-shaped water tank with the water pressurized by a water pump and controlled by a single valve. U.S. Pat. No. 3,458,885 to J. O. Danielsson on Aug. 5, 1969 shows a concrete aggregate exposing apparatus onto which a water hose is connected. The device is rotary brusher that moistens the surface to expose and sweep the cement and sand on the surface into a receptacle to roughen the surface. U.S. Pat. No. 4,331,297 to Wyllie T. Gipson was issued on May 25, 1982 for a water spray attachment describes a device that includes a hang pump to pressurize the water tank. These devices are difficult to handle and do not place a uniform spray on the surface being prepared. The present apparatus also allows the operator to select a widely varied amount of spray water upon the surface without taxing the strength of the operator.

SUMMARY OF THE INVENTION

The present invention is an improved apparatus for treating cement and other flooring surfaces. The improved apparatus is used in conjunction with a machine that has a frame, a handle on the frame, an internal combustion engine on the frame and a rotary finishing means to smooth the flooring surface including rotary trowels on the frame which are powered by the engine.

The improvement has a reservoir means to store a fluid and a pressurization regulation means connected to the reservoir means to regulate the amount of pressure entering the reservoir means. It also has a control means connected to the reservoir means to control the flow of the fluid from the reservoir means and a nozzle means connected to the control means to direct the flow of the fluid from the control means.

The improved apparatus may have a fluid tank, a filler cap on the fluid tank and at least two first inlet ports in the fluid tank through which the control means enters the tank. It may also have at least two outlet ports in the fluid tank through which the control means exits the fluid tank, a first attachment mean to attach the fluid tank to the handle on the frame and a second inlet port on the fluid tank.

The improved apparatus may have at least two nozzles to direct the flow of the fluid and at least two fluid conduits to transmit the fluid from the fluid tank to the nozzles. The improved apparatus may also have a pressure conduit to transmit pressure to the fluid tank, a first pressure connection means to connect the pressure conduit to an exhaust apparatus of the engine, a second pressure connection means to connect the pressure conduit to the fluid tank through the second inlet port and a pressurization regulation valve connected to the pressure conduit. The pressurization regulation valve may also be connected to the first pressure connection means.

The improved apparatus may also have at least two control valves, a linkage means attached to each control valve to open and close the control valve and an actuation means attached to each linkage means to move the linkage means. The apparatus may also have at least two spring-biased push buttons connected to the linkage means and enclosed in a housing to move the linkage means and a second attachment means to attach the housing to the handle. The linkage means may comprise a cable extending through at least one of the first inlet ports and into an interior of the fluid tank, a link to connect the cable to the control valve and a sheath to protect and guide the cable. The fluid tank may be placed on the handle to better balance the apparatus.

The improved apparatus may include a diameter of a passageway, through which the fluid passes, of at least one of the nozzles that is larger than the diameter of the passageway of at least one of the other nozzles to allow a user to vary the amount of fluid being sprayed on the flooring surface by actuation of at least one of the push buttons and opening at least one of the control valves to at least one nozzle with the selected passageway diameter.

It is an object of this invention to provide an improved sprayer for a rotary trowel that will provide a more uniform and controlled application of fluid to a flooring surface such as moist concrete, cement and the like.

It is one object of this invention to supply an improved apparatus that utilizes the exhaust pressure of an internal combustion engine to pressurize the fluid tank to pressurize the water to be sprayed on the flooring surface and thereby reducing a great deal of additional weight that would otherwise be caused by compressors or fluid pumps.

It is another object of this invention to provide an improved apparatus that will be easier and more efficient for the operator to use because of an improved balance and reduction of weight.

DESCRIPTION OF THE PREFERRED EMBODIMENT

Figure 1:
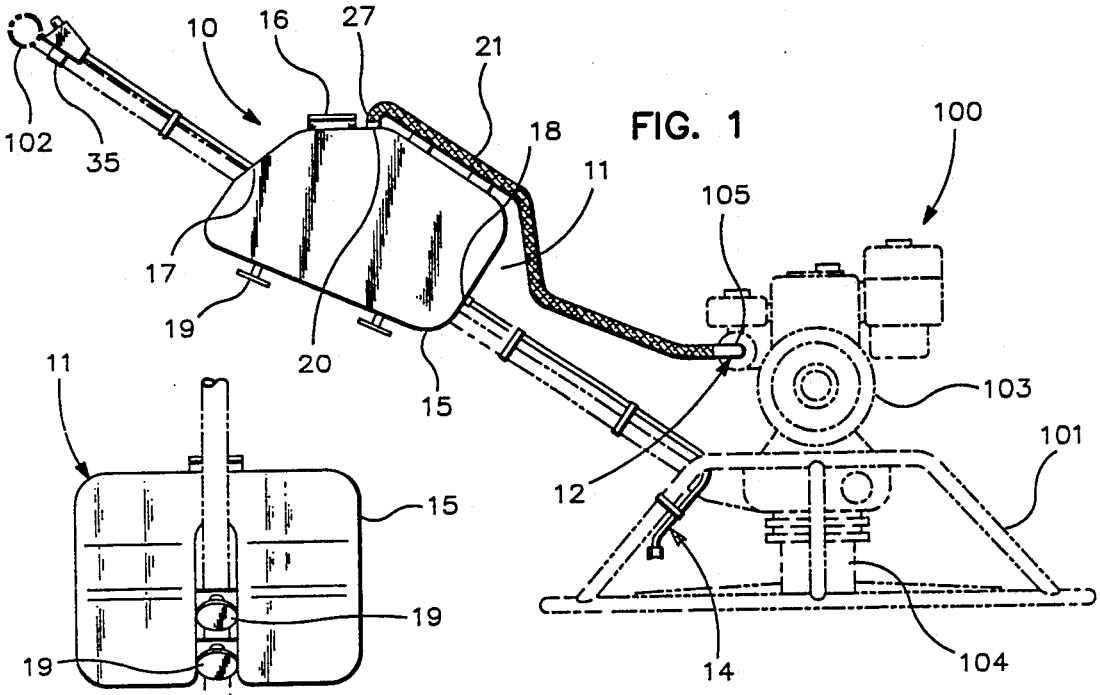
FIG. 1 is longitudinal view of the improved apparatus connected to an exhaust outlet with the rotary trowel machine shown in phantom.
Figure 2:
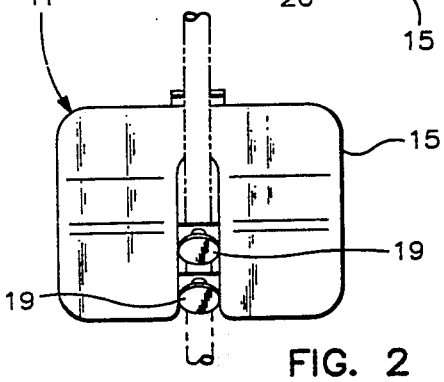
FIG. 2 is a longitudinal view of the underside of the fluid tank shown attached to the handle. A partial view of the handle of the rotary trowel machine is shown.

FIG. 1 shows the improved apparatus 10 for treating cement and other flooring surfaces. The improved apparatus is shown attached to a rotary trowel machine 100 that consists of a frame 101, a handle 102 on the frame 101, an internal combustion engine 103 on the frame 101 and a rotary finishing means 104 to smooth the flooring surface (not shown) on the frame 101 powered by the engine 103.

FIGS. 1,2,3,4,5 6 and 7 show the reservoir means 11 to store a fluid (not shown) and the pressurization regulation means 12 connected to the reservoir means 11 to regulate the amount of pressure entering the reservoir means 11. There is a control means 13 connected to the reservoir means 11 to control the flow of fluid from the reservoir means 11 and a nozzle means 14 connected to the control means 13 to direct the flow of the fluid from the control means.

The reservoir means 11 includes a fluid tank 15, a filler cap 16 on the fluid tank 15, at least two first inlet ports 17 (only one of the first ports is shown) through which the control means 13 enters the fluid tank. There are at least two outlet ports 18 (only one of the outlet ports are shown) through which the control means 13 exits the fluid tank 15. The fluid tank 15 may be constructed of a preformed plastic material or other suitable material. The filler cap 16 may, if desired, be a pressure relief cap preset to reduce the pressure in the fluid tank 15 if the pressure in the tank 15 should ever reach above a predetermined pressure.

Figure 6:
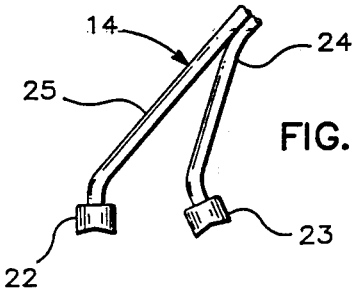
FIG. 6 is a fragmented longitudinal view of the pressurization regulation means with a partial longitudinal view of the pressure conduit attached to the regulation means and showing the first pressure connection means attached to the regulation means.
Figure 7:
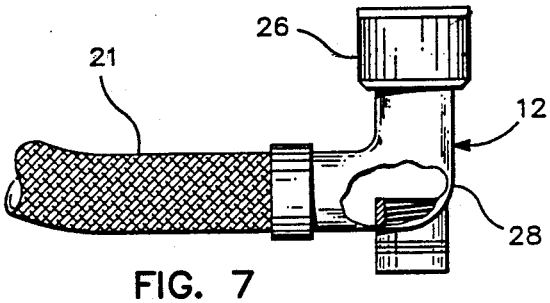
FIG. 7 is a fragmented view of the pressure regulation means connected to a partial view of the pressure conduit.

There is a first attachment means 19 to attach the fluid tank 15 to the handle 102 on the frame 101 and a second inlet port 20 on the fluid tank where the pressure conduit 21 enters the tank 15. Shown in FIGS. 1 and 6 are at least two nozzles 22 and 23 (only two are shown, more could be used) to direct the flow of the fluid and at least two fluid conduits 24 and 25 to transmit the fluid from the fluid tank to the nozzles 22 and 23. Flexibility in the fluid conduits is desirable in order to allow the operator to fine tune the direction of the spray and the placement of the nozzles.

The pressure conduit 21 transmits pressure from the exhaust system 105 of the engine 103 to the fluid tank 15. A first pressure connection means 26 is used to connect the pressure conduit to the exhaust apparatus 105 of the engine 103. There is a second pressure connection means 27 to connect the pressure conduit 21 to the fluid tank. One end of the pressure conduit is connected to the fluid tank and the other end of the pressure conduit is connected to the exhaust apparatus of the engine. The pressure created by the exhaust of the engine pressurizes the fluid tank. There is a pressurization regulation valve 28 connected to the pressure conduit 21 to regulate the amount of pressure entering the fluid tank. The pressure in excess of a preset value is vented to atmosphere. The pressurization regulation valve 28 is usually connected to the first pressure connection means 26.

Sealing of the ports in the fluid tank 15 may be accomplished by conventional methods. The fluids used could be water or any fluid useful in preparing the flooring surface as long as such fluids are not corrosive to the materials used in the construction of the apparatus. Reasonable care should be used in the use of all fluids and in the use of the apparatus to reduce the chance of an accidental injury or property damage. Eye protection and proper protective clothing should be used at all times with rotating and spraying equipment.

Figure 3:
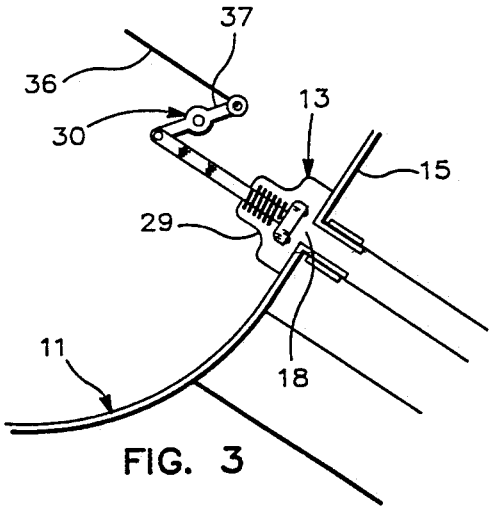
FIG. 3 is a partial schematical cross-sectional view of a portion of the fluid tank and the location of one of the control valves with a linkage means attached and one of the fluid conduits leading therefrom.
Figure 4:
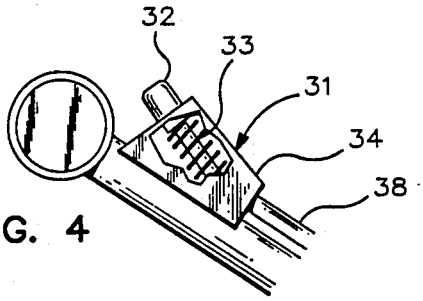
FIG. 4 is a fragmented side view of the actuation means with the spring-biased push button on a partial view of the handle.
Figure 5:
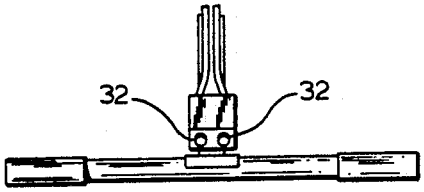
FIG. 5 is a top view of FIG. 4.

The control means 13 has at least two control valves 29 (only one is shown in FIG. 3) and a linkage means 30 is attached to each control valve 29. There is an actuation means 31 attached to each linkage means 30 to move the linkage means. The actuation means 31 has at least two spring-biased push buttons 32 shown in FIG. 4 with spring 33 connected to the linkage means 30 to move the linkage means and are enclosed in housing 34. The housing 34 is attached to the handle 102 by a second attachment means 35 shown in FIG. 1. The linkage means has a cable 36 extending through at least one of the first inlet ports 17, a link 37 to connect the cable 36 to the control valve 29 and a sheath 38 to protect and guide the cable 36. The fluid cable fluid tank 15 is preferably placed on a point on the handle 102 that will allow the operator to make use of the weight of the fluid and the tank 15 to counter-balance the weight of the frame, engine and rotary finishing means thereby causing the operator less tiring exertion.

The diameter of the passageway (not shown), through which the fluid passes, of at least one of the nozzles 22, 23 and others (not shown) may be larger than at least one of the other nozzles. This allows the user to vary the amount of fluid being sprayed on the flooring surface by actuation of at least one of the push buttons 32 and opening at least one of the control valves 29 to at least one of the nozzles 22, 23 or the others. The operator, by this means may select one or any of the other nozzles or all of them to vary the amount of fluid to be sprayed on the surface. The varying diameter passageways and the amount of nozzles used allow the user a great deal of control over the amount of fluid placed on the surface.

The foregoing descriptions and drawings of the invention are explanatory and illustrative only, and various changes in shapes, sizes and arrangement of parts as well as certain details of the illustrated construction may be made within the scope of the appended claims without departing from the true spirit of the invention.

I claim:

1. An improved apparatus for treating cement and other flooring surfaces having a frame, a handle on the frame, an internal combustion engine on the frame and a rotary finishing means to smooth the flooring surface on the frame powered by the engine, wherein the improvement comprises:

a. a fluid tank;

b. a filler cap on the fluid tank;

c. a control means connected to the fluid tank to control the flow of fluid from the fluid tank; wherein the control means further comprises: at least two control valves;

a linkage means attached to each control valve to open and close the control valve; and an actuation means attached to each linkage means to move the linkage means;

d. at least two first inlet ports in the fluid tank through which the control means enters the fluid tank;

e. at least two outlet ports in the fluid tank through which the control means exits the fluid tank;

f. an first attachment means on the fluid tank to attach the fluid tank to the handle on the frame;

g. at least two nozzles to direct the flow of the fluid;

h. at least two fluid conduits to transmit the fluid from the fluid tank to the nozzles;

i. an second inlet port in the fluid tank;

j. a pressure conduit to transmit pressure to the fluid tank;

k. a first pressure connection means to connect the pressure conduit to an exhaust apparatus of the engine;

l. a second pressure connection means to connect the pressure conduit to the fluid tank through the second inlet port; and m. a pressurization regulation valve connected to the pressure conduit.

2. An improved apparatus as defined in claim 1 wherein the pressurization regulation valve is connected to the first pressure connection means.

3. An improved apparatus as defined in claim 1 wherein the actuation means further comprises:

a. at least two spring-biased push buttons connected to the linkage means and enclosed in a housing to move the linkage means; and b. a second attachment means to attach the housing to the handle.

4. An improved apparatus as described in claim 1 wherein the linkage means further comprises:

a. a cable extending through at least one of the first inlet ports and into an interior of the fluid tank;

b. a link to connect the cable to the control valve; and c. a sheath to protect and guide the cable.

5. An improved apparatus as defined in claim 1 wherein a diameter of a passageway, through which the fluid passes, of at least one of the nozzles is larger than the diameter of the passageway of at least one of the other nozzles to allow a user to vary the amount of fluid being sprayed on the flooring surface by actuation of at least one of the push buttons and opening at least one of the control valves to at least one nozzle with the selected passageway diameter.

* * * * *